US008495798B1

(12) United States Patent
Parker

(10) Patent No.: US 8,495,798 B1
(45) Date of Patent: Jul. 30, 2013

(54) DOOR FIXTURE WITH DECORATIVE PANELS

(76) Inventor: Alan F. Parker, Henderson, KY (US)

( * ) Notice: Subject to any disclaimer, the term of this patent is extended or adjusted under 35 U.S.C. 154(b) by 0 days.

(21) Appl. No.: 13/401,386

(22) Filed: Feb. 21, 2012

(51) Int. Cl.
*A45C 3/00* (2006.01)

(52) U.S. Cl.
USPC ..... 16/414; 40/331

(58) Field of Classification Search
USPC ..... 40/414, 417, 433, 441, DIG. 30, 40/325, 331, 332, 489, 599, 606.07, 618; 292/347; 74/553; 116/277; 16/414, 417, 433, 16/441, DIG. 30
See application file for complete search history.

(56) References Cited

U.S. PATENT DOCUMENTS

| | | | | | |
|---|---|---|---|---|---|
| 85,799 | A * | 1/1869 | Day | 292/347 |
| 159,509 | A * | 2/1875 | Haines | 292/347 |
| 600,849 | A * | 3/1898 | Brown | 40/331 |
| 1,755,301 | A * | 4/1930 | McCullough | 16/417 |
| 2,507,392 | A * | 5/1950 | Williams | 40/331 |
| 2,617,216 | A * | 11/1952 | Kilgour | 40/331 |
| 3,024,555 | A * | 3/1962 | Abeles | 40/331 |
| 5,499,427 | A * | 3/1996 | Bowman | 16/417 |
| 6,687,957 | B2 * | 2/2004 | Worrell | 16/433 |
| 6,842,946 | B2 * | 1/2005 | Hayden | 16/414 |
| 7,963,003 | B1 * | 6/2011 | Keene | 16/441 |
| 8,132,295 | B1 * | 3/2012 | Otis et al. | 16/412 |
| 8,360,488 | B2 * | 1/2013 | Forrest et al. | 292/348 |
| 2004/0078933 | A1 * | 4/2004 | Forrest | 16/417 |
| 2007/0069090 | A1 * | 3/2007 | Driscoll | 248/206.5 |

OTHER PUBLICATIONS

Decorative Door Hardware, Aug. 2011, p. 36. Publisher, Emtek Assa Abloy, City of Industry, CA, USA.

* cited by examiner

*Primary Examiner* — William Miller
(74) *Attorney, Agent, or Firm* — Brian W. Chellgren; James C. Eaves, Jr.; Bingham Greenebaum Doll LLP

(57) ABSTRACT

The present invention relates to a door fixture with decorative panels. More particularly, the present invention relates to a door fixture comprising a handle attached to a door plate, a handle panel attached to the handle and a door plate panel attached to the door plate, the door plate being affixed to a door.

22 Claims, 7 Drawing Sheets

DOOR FIXTURE WITH DECORATIVE PANELS

BACKGROUND OF THE INVENTION (a) Field of the Invention

The present invention relates to a door fixture with decorative panels. More particularly, the present invention relates to a door fixture comprising a handle attached to a door plate, a handle panel attached to the handle and a door plate panel attached to the door plate, the door plate being affixed to a door.

(b) Description of the Prior Art

Doors commonly include handles for ease of opening and closing. Door handles may be knobs, levers, or other graspable shapes. Escutcheon plates or door plates are often placed around door handles for ornamental or protective purposes. Individuals generally select door fixtures such as door handles and door plates for aesthetic purposes, such as matching an overall decorative scheme for a room or a building. However, some individuals may desire a greater ability to customize their door fixtures than simply selecting a color, material, and design style. A desirable feature for a door fixture would be a capability to customize its appearance to reflect the interests and aesthetic sensibilities of its owner.

SUMMARY OF THE INVENTION

The present invention is directed to a door fixture that includes decorative panels, allowing an individual to customize the appearance of the fixture. The door fixture system includes a door plate and an attached door handle. The door plate is attached to a door and includes an outer face opposite the door. The handle includes a graspable portion and a stem extending therefrom. The graspable portion of the handle has an outer face opposite the stem. A handle panel is attached to the outer face of the handle, and a door panel is attached to the outer face of the door plate. The door panel and door plate include complementary apertures adapted to serially receive a at least portion of the handle portion of the door handle. Preferably, the door panel and door plate each include decorative designs which provide complementary aesthetic meaning, such as, for example, a sports team logo on the handle panel and the team name on the door panel, or a race car number on the handle panel and a picture of the car on the door panel.

There are four common types of door handles: dummy, passage, privacy, and entrance. Dummy handles do not have latching or locking mechanisms and are often used for aesthetic purposes. Passage handles have latching devices but do not have locking mechanisms and are commonly used on hall or closet doors. Privacy handles have latching and locking mechanisms and are commonly used on bedroom and bathroom doors. Entrance handles are typically used on exterior doors and include privacy handles and keyed cylinders, i.e., deadbolts.

The present invention is compatible with all four types of door handles. Latching mechanisms are commonly engaged by rotating door handles and do not modify the outward appearance of door handles containing such. Handles with locking mechanisms include buttons, rotatable elements or other means for engaging the locking mechanism. These means for engaging the locking mechanism may be located on the outer face of the graspable portion of the handle or elsewhere on the handle or door plate. Preferably, the present invention is used with privacy and entrance handles that have means for engaging the locking mechanism positioned apart from the outer face of the graspable portion of the handle. As such, the decorative handle panel may cover substantially the entire outer face of the handle without need for a hole or passage for accessing the means for engaging the locking mechanism.

In one embodiment, the present invention is a door fixture for attachment to a door, the door fixture comprising: a door plate for mounting on a door, the door plate having a door plate inner face, a door plate outer face opposite the door plate inner face, and at least one side adjoining both the door plate inner face and the door plate outer face, wherein the door plate outer face includes a door plate aperture; a handle having a graspable portion and a stem extending therefrom, the graspable portion having a handle outer face opposite the stem; a handle panel attached to the handle outer face; and a door panel attached to the door plate outer face, the door panel including a door panel aperture aligned with the door plate aperture; wherein a portion of the stem extends serially through the door panel aperture into the door plate aperture, and wherein the handle panel and the door panel display related decorative designs.

BRIEF DESCRIPTION OF THE DRAWINGS

A better understanding of the present invention will be had upon reference to the following description in conjunction with the accompanying drawing, wherein.

DETAILED DESCRIPTION OF THE PREFERRED EMBODIMENT

Figure 1:
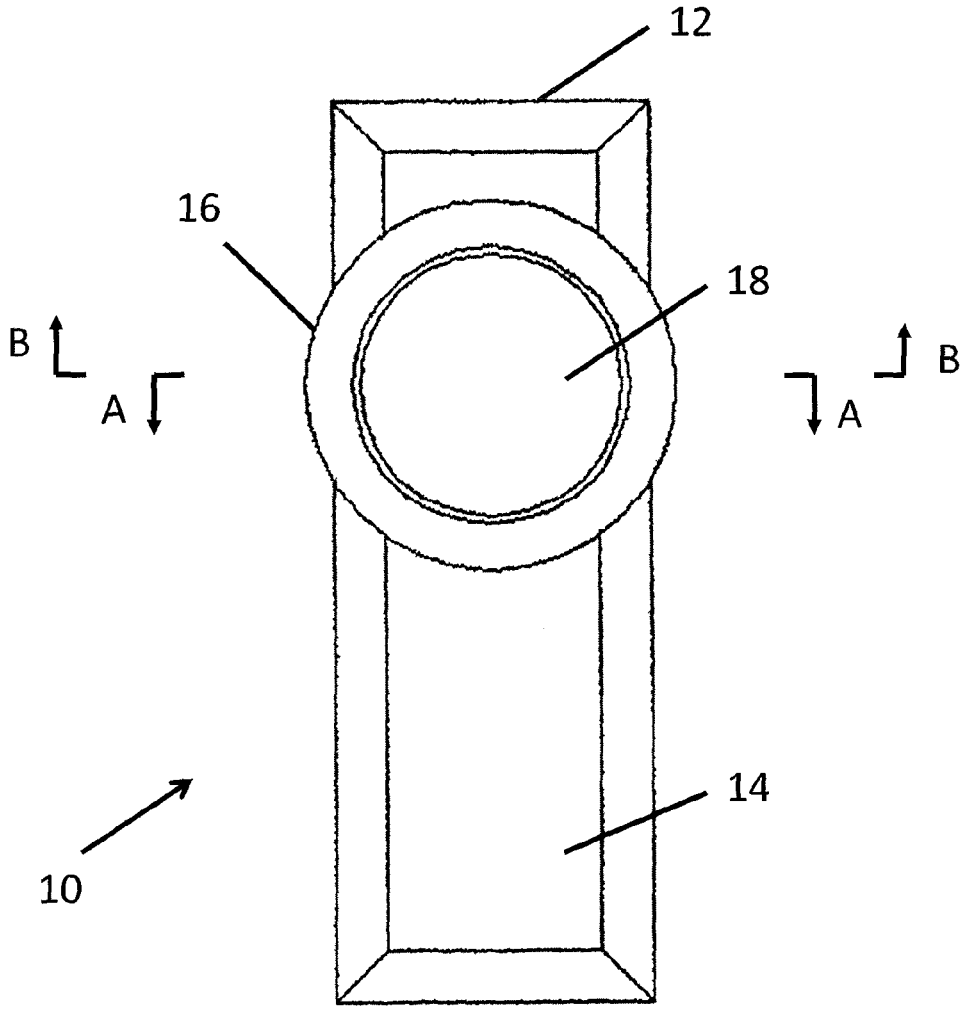
FIG. 1 depicts a front view of a door fixture.
Figure 2:
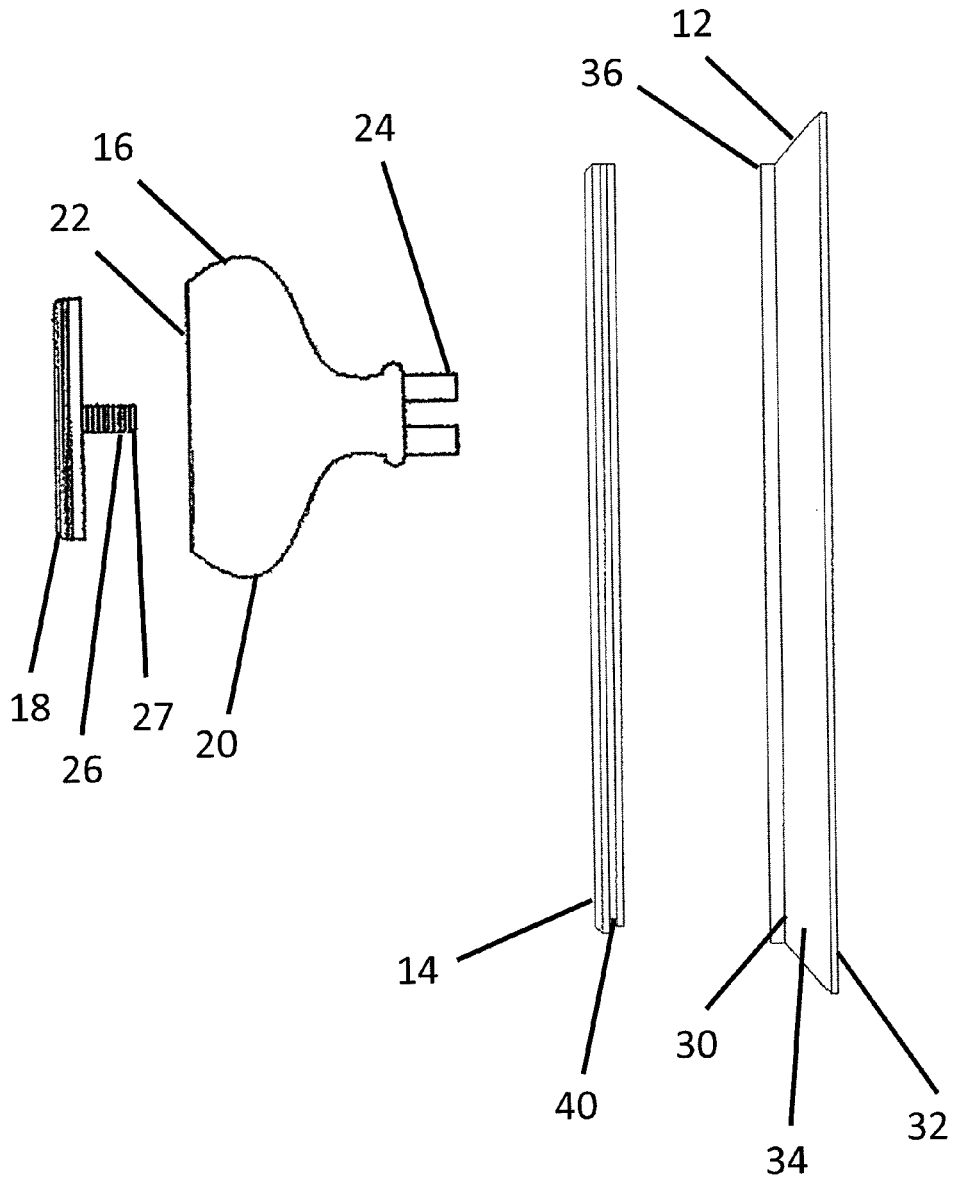
FIG. 2 depicts an exploded side view of the door fixture.
Figure 3:
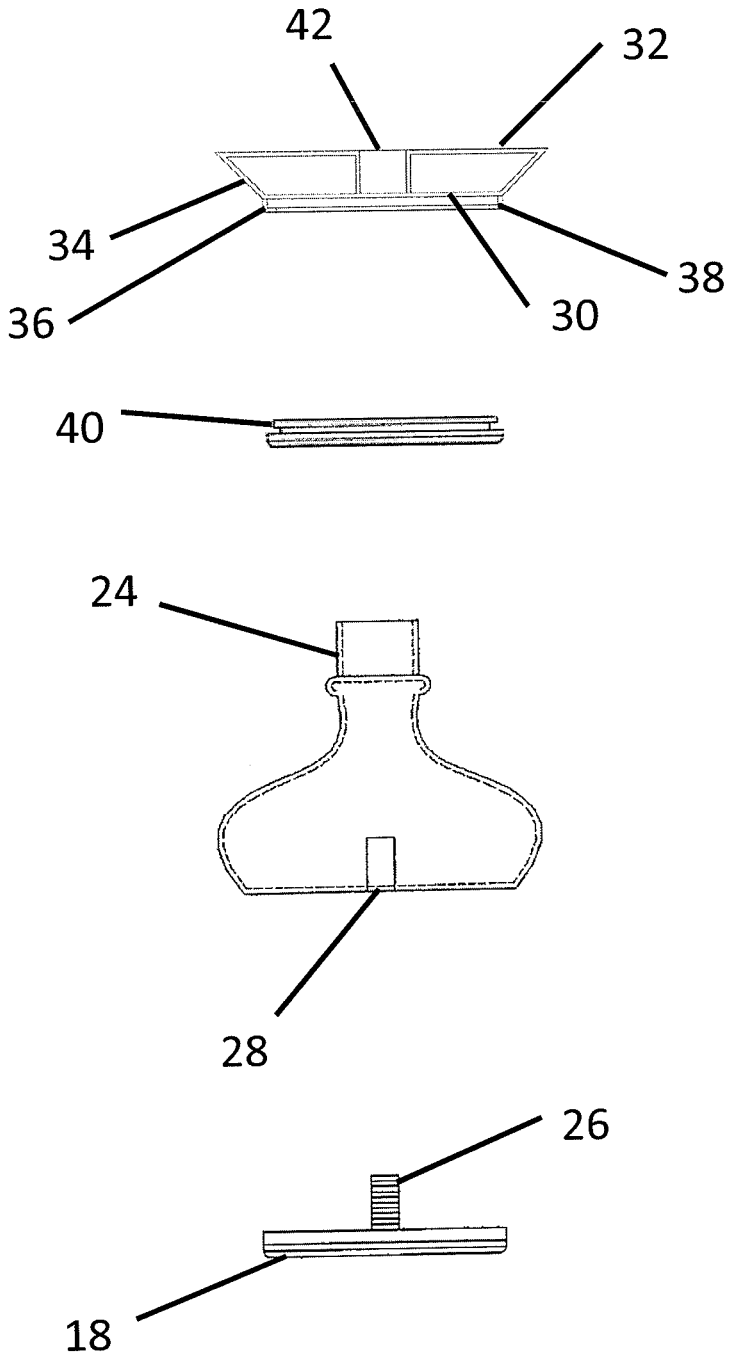
FIG. 3 depicts an exploded top view of a door fixture, with the door plate and handle sectioned along line A-A of FIG. 1.
Figure 4A:
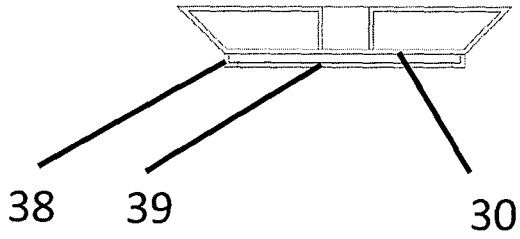
FIG. 4A depicts a cross-sectional view of the door plate along line A-A of FIG. 1.
Figure 4B:
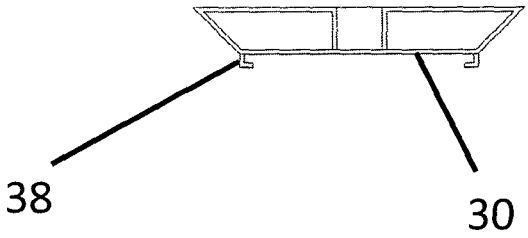
FIG. 4B depicts a cross-sectional view of the door plate along line B-B of FIG. 1.
Figure 5A:
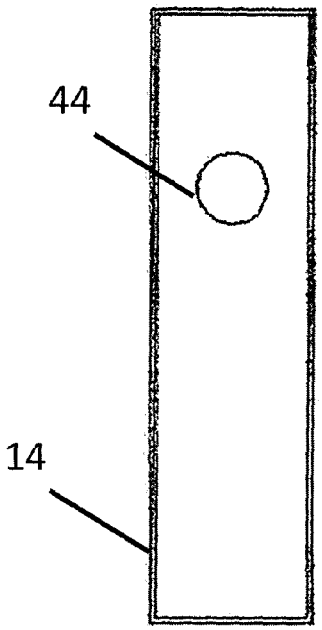
FIG. 5A depicts a front view of a door panel.
Figure 5B:
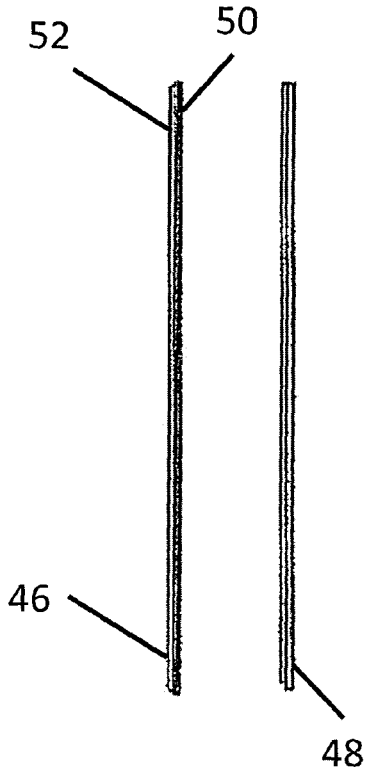
FIG. 5B depicts a side exploded view of the door panel.
Figure 5C:
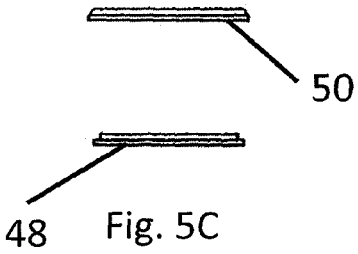
FIG. 5C depicts a top exploded view of the door panel.
Figure 5D:
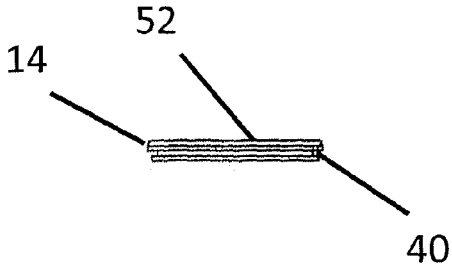
FIG. 5D depicts a side view of the door panel.

FIGS. 1-6 depict a door fixture 10 comprising a door plate 12 with attached door panel 14 and a door handle 16 with attached handle panel 18. The handle 18 includes a graspable portion 20 and a handle outer face 22 opposite the door plate 12. The handle outer face 22 is preferably a substantially flat surface. The handle 16 also includes a stem portion 24 extending opposite the handle outer face 22 in the direction of the door plate 12. The handle panel 18 includes handle attachment means 26 for securing the handle panel 18 to the handle outer face 22. In one embodiment, as shown in FIGS. 2, 3, 6B, and 6C the handle attachment means 26 is an elongated threaded rod 27 configured to be secured within a corresponding threaded handle bore 28 in the handle outer face 22. In another embodiment, the handle attachment means 26 is an adhesive. The handle panel 18 covers at least a portion of the handle outer face 22. Preferably, the handle panel 18 covers substantially the entire surface of the handle outer face 22.

The door fixture 10 is configured to be installed on a door. As used herein, the term "inner" refers to an orientation in the direction of the surface of a door upon which the door fixture 10 is attached. The term "outer" refers to an orientation opposite that of "inner." The term "height" refers to a distance perpendicular to the surface of the door. The terms "top" and "bottom" refer to the uppermost and lowermost parts of an object, from the view of an observer facing the door fixture 10 as installed.

The door plate 12 is designed to be mounted on a door and includes a plate outer face 30, a plate inner face 32 opposite the plate outer face 30, and at least one side 34 contiguous to both the plate outer face 30 and plate inner face 32. The door plate 12 includes plate attachment means 36 for securing the door panel 14 to the plate outer face 30. In one embodiment, the plate attachment means 36 is an adhesive. In another embodiment, as shown in FIGS. 2, 3, 4A and 4B, the plate attachment means 36 is a pair of upside-down "L-shaped" side support rails 38 extending perpendicular from the sides of the plate outer face 30 then angled parallel to the plate outer face 30. The plate attachment means 36 further includes a third upside-down "L-shaped" bottom support rail 39 extending perpendicular from the bottom of the plate outer face 30 then angled parallel to the plate outer face 30. In this embodiment, the parallel portions of the support rails 38, 39 are configured to fit within a corresponding groove 40 within the door panel 14. As visible in FIGS. 2, 3, and 4A and 4B, the plate outer face 30 is substantially rectangular in shape and the support rails 38, 39 extend along both sides and the bottom of the plate outer face 30. In this embodiment, the door panel 14 may be secured to the door plate 12 by sliding the door panel 14 downwards onto the side support rails 38 and coming to rest on the bottom support rail 39, such that the support rails 38,39 mechanically interlock with the groove 40.

In a preferred embodiment, the door plate 12 and door panel 14 each include complementary apertures 42, 44. A portion of the stem portion 24 of the door handle 16 serially passes through the door panel aperture 44 and into the door plate aperture 42. The portion of the stem portion 24 extending through the door panel aperture 44 mechanically secures the door panel 14 to the door plate 12.

The door panel 14 and handle panel 18 each include a decorative design, which may include an image, words, or a combination of the two, such as, for example, a sports team logo, a sports team name, an image of a famous individual, an image of an animal, an image of a vehicle, or other desirable design. Preferably the decorative designs on the door panel 14 and handle panel 18 are complementary and provide a consistent decorative theme, such as, for example, a sports team logo on the handle panel 18 and the team name on the door panel 14, or an image of a skull and cross bones on the handle panel 18 and the words "abandon hope all ye who enter" on the door panel 14.

In one embodiment, as shown in FIGS. 5A-5D, the door panel 14 is comprises a first door panel part 46 and a second door panel part 48. The first door panel part 46 is a transparent material and the second door panel part 48 is an opaque material. The first door panel part 46 includes a first door panel inner surface 50 and an opposing first door panel outer surface 52. In this embodiment, a decorative design is applied on the first door panel inner surface 50 of the first door panel part 46. The first door panel inner surface 50 is then secured to the second door panel part 48 by an attachment means, such as, for example, a transparent adhesive. The door panel 14 is attached to the door plate 12 such that the first door panel outer surface 52 of the first door panel part 46 is arranged outwards from the door plate 12. The first door panel part 46 is sized to cover at least a portion of the plate outer face 30. In the preferred embodiment shown in FIGS. 1-3 and 5A-5D, the first door panel part 46 is sized to cover substantially all of the plate outer face 30.

In the embodiment shown in FIGS. 5A-5D, the first door panel part 46 and second door panel part 48 are designed to form a groove 40 when combined to form the door panel 14. A notch is formed in the edges of the surface of the rectangular second door panel part 48 which will contact the first door panel part 46. When the first door panel part 46 and second door panel part 48 are secured together, the notch and first door panel inner surface 50 cooperatively form the groove 40.

The decorative design may be applied to the door panel 14 via screen printing, drawing, painting, carving, etching, or other suitable means. In a preferred embodiment, the decorative design is applied via screen printing to a first door panel inner surface 50 of a transparent first door panel part 44 made of acrylic. In this embodiment, the opaque second door panel part 48 is also made of acrylic. The opaque second door panel part 48 serves as the background of the decorative design on the first door panel part 46. In another embodiment, the decorative design is applied via screen printing to an opaque acrylic second door panel part 48, and a transparent acrylic first door panel part 46 includes no markings. By applying the design to one of the first door panel inner surface 50 and the second door panel part 48, and irreversibly securing the two together, moisture, abrasions, and scratches cannot reach and damage the design. Instead, the design is viewed through the transparent body of the first door panel part 48.

Figure 6A:
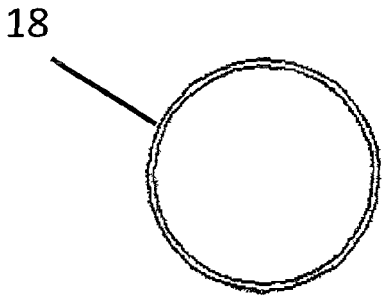
FIG. 6A depicts a front view of a handle panel.
Figure 6B:
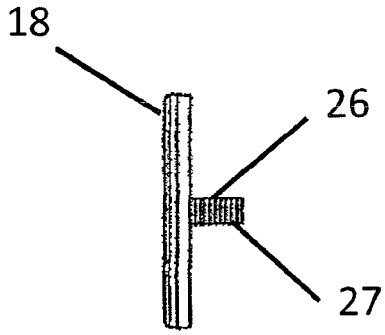
FIG. 6B depicts a side view of the handle panel.
Figure 6C:
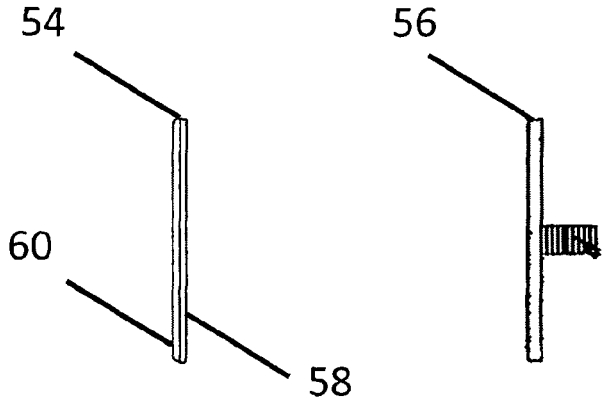
FIG. 6C depicts a side exploded view of the handle panel.

The handle panel 18 is constructed using similar techniques as the door panel 14. In one embodiment, as shown in FIGS. 6A-6C, the handle panel 18 is constructed of a first handle panel part 54 and a second handle panel part 56. The first handle panel part 54 is a transparent material and the second handle panel part 56 is an opaque material. The first handle panel part 54 includes a first handle panel inner surface 58 and an opposing first handle panel outer surface 60. In this embodiment, a decorative design is applied to one of the first handle panel inner surface 58 and the second handle panel part 56 using techniques as described above for the door panel 14. The first handle panel inner surface 58 is then secured to the second handle panel part 56 by an attachment means, such as, for example, a transparent adhesive. The handle panel 18 is attached to the handle outer face 22 such that the first handle panel outer surface 60 is arranged outwards from the door handle 16. The handle panel 18 is sized to cover at least a portion of the handle outer face 22. In a preferred embodiment, the handle panel 18 is sized to cover substantially all of the handle outer face 22.

Figure 7:
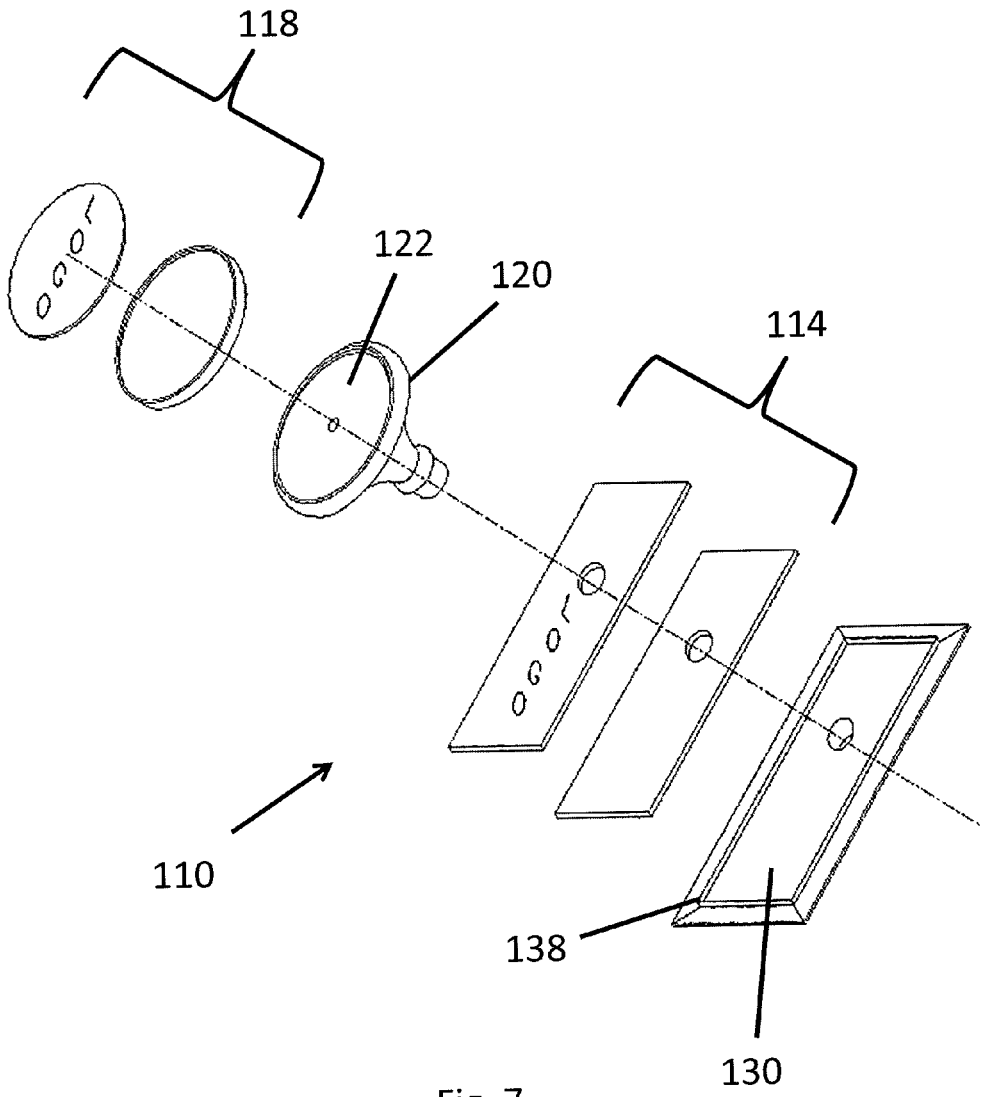
FIG. 7 depicts a perspective exploded view of a second embodiment of a door fixture.

FIG. 7 depicts a second embodiment of a door fixture 110 within the scope of the present invention. This second embodiment is substantially identical to the first embodiment, except as described below.

In this second embodiment, the handle outer face 122 is recessed into the graspable portion 120 to a distance equal to the height of the handle panel 118, such that outer surface 160 of the handle panel 118 is flush with the graspable portion 120 and provides the appearance that the handle panel 118 and graspable portion 120 are a single piece. In this embodiment, the plate attachment means 136 is a flange 138 extending outward from the perimeter of the plate outer face 130 to a height substantially equal to the height of the door panel 114, such that the outer surface 152 of the door panel 114 is flush with the flange 138 and provides the appearance that the door panel 114 and the door plate 112 are a single piece. The door panel 114 is affixed to the plate outer face 130 and flange 138 via an adhesive or other suitable means.

While the present invention is discussed and shown primarily in context of an axially symmetric knob-type door handle 16 attached to a generally rectangular door plate 12, the invention is not limited to these particular shapes. The door plate 12 may be generally circular, oval, or a non-standard shape. The door handle 16 may be a knob, lever, or other graspable shape. The present invention may also be used in residential, commercial, industrial, or other settings. In one embodiment, the decoration on the door fixture 10 may also serve a functional purpose in addition to an aesthetic purpose. For example, the decoration on the door fixture 10 used in a laboratory setting could include a radioactivity hazard design on the handle panel 16 and the words "Warning: Radiation Hazard" on the door panel 14. For another example, the door fixture used on a restroom in a commercial facility could include the word "Women" on the handle panel 16 and a design showing the outline of a woman on the door panel 14.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A door fixture for attachment to a door, said door fixture comprising:

a door plate said door plate having a door plate inner face, a door plate outer face opposite said door plate inner face, and at least one side adjoining both said door plate inner face and said door plate outer face;

a handle having a graspable portion and a stem extending therefrom and attached to said door plate, said graspable portion having a handle outer face opposite said stem, wherein said stem is attached to said door plate;

a handle panel attached to said handle outer face by handle attachment means; and a door panel attached to said door plate outer face by said door plate outer face including at least one support rail mechanically interlocking with a groove in said door panel.

2. A door fixture for attachment to a door, said door fixture comprising:

a door plate said door plate having a door plate inner face, a door plate outer face opposite said door plate inner face, and at least one side adjoining both said door plate inner face and said door plate outer face;

a handle having a graspable portion and a stem extending therefrom and attached to said door plate, said graspable portion having a handle outer face opposite said stem, wherein said stem is attached to said door plate;

a handle panel attached to said handle outer face by handle attachment means; and a door panel received by a flange extending perpendicular to said plate outer face.

3. The door fixture of claim 2, wherein said handle panel is sized to cover at least a portion of said handle outer face.

4. The door fixture of claim 3, wherein said handle panel is sized to cover substantially all of said handle outer face.

5. The door fixture of claim 2, wherein said handle outer face is recessed.

6. The door fixture of claim 2, wherein said door panel and said handle panel each include decorative designs.

7. The door fixture of claim 6, wherein said door panel and said handle panel each comprise a first transparent part attached to a second opaque part, said first transparent part including an inner face contacting said second opaque part and an outer face opposite said inner face.

8. The door fixture of claim 7, wherein said decorative designs are applied to one of said inner faces of said first transparent parts and said second opaque parts of said of said door panel and said handle panel, whereby said decorative designs are visible through said first transparent parts.

9. A door fixture for attachment to a door, said door fixture comprising:

a door plate said door plate having a door plate inner face, a door plate outer face opposite said door plate inner face, and at least one side adjoining both said door plate inner face and said door plate outer face;

a handle having a graspable portion and a stem extending therefrom and attached to said door plate, said graspable portion having a handle outer face opposite said stem, wherein said stem is attached to said door plate;

a handle panel attached to said handle outer face by handle attachment means; and a door panel attached to said door plate outer face by plate attachment means;

wherein said door panel includes a first door panel part attached to a second door panel part, wherein said first door panel part includes a first door panel inner surface contacting said second door panel part and a first door panel outer surface opposite said first door panel inner surface;

wherein said first door panel part is constructed of a substantially transparent material and wherein said second door panel part is constructed of a substantially opaque material.

10. The door fixture of claim 9, wherein a decoration is located on one of said first door panel inner face and said second door panel part, such that said decoration is visible through said first door panel part.

11. The door fixture of claim 9, wherein said first door panel part is sized to cover at least a portion of said plate outer face.

12. The door fixture of claim 11, wherein said first door panel part is sized to cover substantially all of said plate outer face.

13. The door fixture of claim 9, wherein said handle panel includes comprises a first handle panel part attached to a second handle panel part, wherein said first handle panel part includes a first handle panel inner surface contacting said second handle panel part and a first handle panel outer surface opposite said first handle panel inner surface.

14. The door fixture of claim 13, wherein said first handle panel part is constructed of a substantially transparent material and wherein said second handle panel part is constructed of a substantially opaque material.

15. The door fixture of claim 14, wherein a decoration is located on one of said inner face of said first handle panel part and said second handle panel part, such that said decoration is visible through said first handle panel part.

16. A door fixture for attachment to a door, said door fixture comprising:

a door plate said door plate having a door plate inner face, a door plate outer face opposite said door plate inner face, and at least one side adjoining both said door plate inner face and said door plate outer face;

a handle having a graspable portion and a stem extending therefrom and attached to said door plate, said graspable portion having a handle outer face opposite said stem, wherein said stem is attached to said door plate;

a handle panel attached to said handle outer face by handle attachment means; and a door panel attached to said door plate outer face by plate attachment means;

wherein said door panel includes a first door panel part attached to a second door panel part, wherein said first door panel part includes a first door panel inner surface contacting said second door panel part and a first door panel outer surface opposite said first door panel inner surface;

wherein said first door panel part and said second door panel part cooperatively form a groove for receiving said plate attachment means.

17. The door fixture of claim 16, wherein said first door panel part is sized to cover at least a portion of said plate outer face.

18. The door fixture of claim 17, wherein said first door panel part is sized to cover substantially all of said plate outer face.

19. The door fixture of claim 16, wherein said handle panel includes comprises a first handle panel part attached to a second handle panel part, wherein said first handle panel part includes a first handle panel inner surface contacting said second handle panel part and a first handle panel outer surface opposite said first handle panel inner surface.

20. The door fixture of claim 19, wherein said first handle panel part is constructed of a substantially transparent material and wherein said second handle panel part is constructed of a substantially opaque material.

21. The door fixture of claim 20, wherein a decoration is located on one of said inner face of said first handle panel part and said second handle panel part, such that said decoration is visible through said first handle panel part.

22. A door fixture for attachment to a door, said door fixture comprising:

a door plate said door plate having a door plate inner face, a door plate outer face opposite said door plate inner face, and at least one side adjoining both said door plate inner face and said door plate outer face;

a handle having a graspable portion and a stem extending therefrom and attached to said door plate, said graspable portion having a handle outer face opposite said stem, wherein said stem is attached to said door plate;

a handle panel attached to said handle outer face by handle attachment means; and a door panel attached to said door plate outer face by plate attachment means;

wherein said handle attachment means is a rod extending from said handle panel and inserted within a corresponding handle bore located in said handle outer face.

* * * * *